United States Patent [19]

Miceli

[11] Patent Number: 4,555,822

[45] Date of Patent: Dec. 3, 1985

[54] KNIFE SYSTEM WITH REMOVABLE-ACCESSORY HANDLE LOCK

[76] Inventor: Philip V. Miceli, 1900 Shanklin Ave., Baltimore, Md. 21234

[21] Appl. No.: 671,248

[22] Filed: Nov. 14, 1984

[51] Int. Cl.[4] ..... B26B 11/00; B26B 29/02; F41B 13/04

[52] U.S. Cl. ..... 7/119; 7/158; 7/165; 7/167; 30/153; 403/397

[58] Field of Search ..... 7/158, 119, 167; 30/151, 153, 262; 81/318, 324, 329, 331, 333, 177 D, 177 E; 403/397, 398; 24/573

[56] References Cited

U.S. PATENT DOCUMENTS

| | | | |
|---|---|---|---|
| 542,158 | 7/1895 | Grenthal | 24/573 |
| 2,714,249 | 8/1955 | Clark et al. | 30/153 |
| 3,742,533 | 7/1973 | Brunette | 7/1 G |
| 4,364,174 | 12/1982 | Asis | 30/153 |

FOREIGN PATENT DOCUMENTS

| | | | |
|---|---|---|---|
| 25646 | of 1906 | United Kingdom | 24/573 |

*Primary Examiner*—Roscoe V. Parker
*Attorney, Agent, or Firm*—John F. McClellan, Sr.

[57] ABSTRACT

A knife system with symmetrical "U"-section swing handles has a removable, integral accessory detachably force fitted to it to lock the handles together in blade-exposed or use-position, and to serve as a scraper, a pair of offset screwdrivers providing finger relief, and a grip improver. The force-fit may advantageously include three types of engagement between the lock and the handles for maximum security. The lock may be easily installed by tapping it with or against something; removal is difficult except by appropriately directed tapping.

5 Claims, 4 Drawing Figures

KNIFE SYSTEM WITH REMOVABLE-ACCESSORY HANDLE LOCK

CROSS-REFERENCE TO RELATED APPLICATIONS

Cross-reference is made to my co-pending applications Ser. No. 479,841, filed 8-28-83 for FOLDING POCKET TOOL AND KNIFE and Ser. No. 624,022 filed 6-25-84 for POCKET FOLDING TOOL AND KNIFE SYSTEM.

FIELD OF THE INVENTION

This invention relates generally to hand tools and specifically to an improved knife system.

BACKGROUND OF THE INVENTION

Knives have been disclosed with blades having pivotal "U"-section handles that extend back-to-back from one end of the blade where they are detachably held together at the free ends to act as a single handle for the exposed blade, and that pivot from that position to a face-to-face position between them encasing the blade for safe storage. Swinging loops have been used for attaching the free ends of the handles, and, in the inventions of the present inventor, pivotal blocks that serve additional uses.

SUMMARY OF THE INVENTION

Knife systems, including tool provisions and knives of the type described, that have been designed and manufactured by the present inventor, have been of stainless steel, with strong pivots, and rugged blades and handles, and are suited for heavy use of all types, including throwing. They provide a heavy conventional screwdriver/scraper for use when the blade is encased by the handles, and two offset screwdrivers.

A principal object of this invention is to provide a heavy duty pivot-free lock system for holding the handles in blade-exposed position for use under the most severe conditions, including knife throwing.

Further objects are to provide a handle lock system as described that extends the uses of the knife by providing a scraper for use with the knife blade exposed, along with two additional offset screwdriver blades that are conveniently angled for finger clearance, all three with removability for sharpening.

Further objects are to provide a handle lock system as described that is easily applied and easily removed without tools, but is secure and backlash-free, and holds the handles free of backlash also, and is symmetrical.

Still further objects are to provide a system as described that can be used as a hammer head to tap objects lightly, that is safe, lightweight, durable, economical, and is attractive in appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 3:
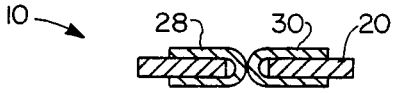
FIG. 3 is a view taken at 3—3, FIG. 1.
Figure 1:
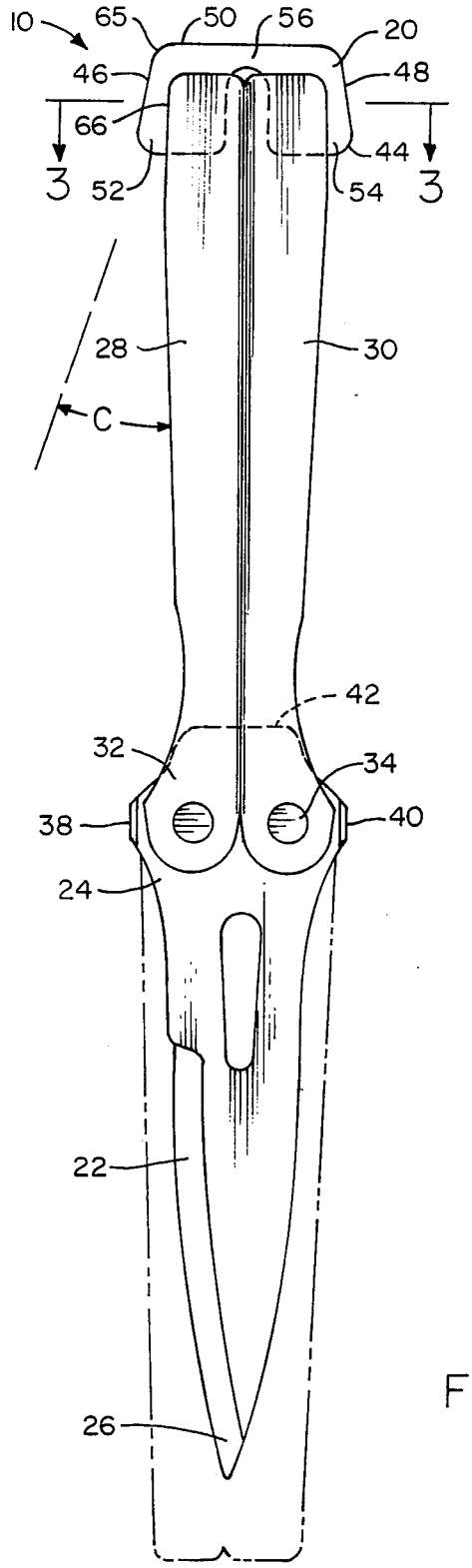
FIG. 1 is a plan view of a tool system including the removable press-fit handle lock in preferred embodiment.
Figure 4:
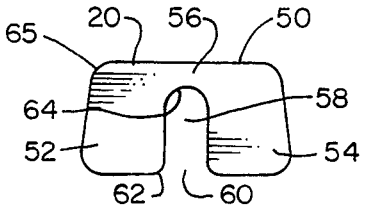
FIG. 4 is a plan view of a portion of the FIG. 1 showing.
Figure 2:
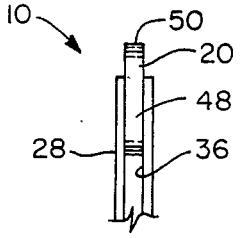
FIG. 2 is a side elevational view thereof, in a detail.

FIGS. 1 through 3 show in embodiment 10 a press-fit handle lock 20. FIG. 4 shows the handle lock 20 by itself. The handle lock 20 is installed as part of a knife system 10 that includes a blade 22 with butt end 24 and point end 26. Paired handles 28, 30 are symmetrically held at the first ends 32 to the blade butt end 24 by respective pivots 34.

The handles have "U"-section cross-sectional shape and the "U"-section grooves 36 that have open ends, and receive in them and encase the blade for storage when the handles are swung to a position (broken lines, FIG. 1) covering the edges of the blade, except for parts 38, 40 and 42 that may be used as offset screwdrivers and scraper respectively, as previously described by the present inventor.

When swung to the open or blade-exposed position shown, the handles provide a sturdy grip for heavy duty use of the knife system, such as in hacking or throwing use.

To hold the handles in the use-position shown, the present inventor has previously disclosed a plural-purpose block pivoted to one handle and detachably engageable with the other handle.

Elsewhere for swing-handle type knives, a pivotal loop has been disclosed to hold the handles together in a use-position.

However, for some uses, such as those mentioned when the knife system is used as a throwing knife, or in heavy hacking, the present invention provides the multipurpose press-fit handle lock or plate 20 that resists accidental release of the handles but that is easily detachable for complete removal when desired, facilitating customary use.

This preferably uniform-thickness member 20 serves not only as a lock, but also has shoulders 44 that serve as slip-resistant grip aids, and easy, tap-off detachment aids, and has a pair of offset screwdriver blades 46, 48 with sides angled to broaden them in a direction toward the first end of the handles, providing finger clearance (arrow "C") and has a scraper blade 50 at the end, easily detached when needed to be sharpened.

The handle lock or plate 20 is preferably symmetrical about the longitudinal centerline of the system, and has two legs 52, 54 that are joined by an integral connection 56 between them, defining a generally uniform-width slot 58 along the centerline. The slot has an open end 60 with rounded corners 62 that facilitate assembly, and at the closed end wall 64 defining a rounded shape. Preferably all corners of the plate are rounded, as shown, for safety, to prevent scarring surfaces engaged, and for ease of removal and assembly. In particular, the two corners 65 between the scraper and the offset screwdriver blades can be used as gouges for making rounded-section grooves.

Assembly is easy and quick. The lock or member 20 is positioned at the second ends 66 of the handles and then tapped into place with the legs 52, 54 going into the open ends of grooves of the handles and the slot 58 receiving and preferably biasing or urging together portions of the spines of the handle. Symmetry aids in assembly.

Three force fits are preferably provided by proportions of the interfitting parts: (1) force fit produced by thickness of the plate from which the lock is made, relative to spacing between the arms of the "U"-section, flexing the arms apart; (2) force fit provided by width of the slot relative to the combined thickness of the spine portions received in it; (3) forcing together of the ends of the spined portions by engagement with the rounded closed-end walls of the slot. This springs the handle together for blade stability.

Assembly tapping may be done by knocking the lock on a surface, or by light tapping with a piece of wood or other suitable hammer. Symmetry helps prevent loosening but makes intentional disassembly easier.

Assembly is very secure against forces in all directions. The rounded shapes of the shoulders 44 tend to prevent loosening when either of them strikes an object in a direction parallel with the handles, although disassembly is easily done by light alternate taps on the shoulders, or by tapping both simultaneously, in a driving direction towards the second ends of the handles. The force fit is such that even with the blade clamped in a device, the removable press-fit handle lock 20 cannot be pulled free manually.

For a knife system with bent, rounded handles of these dimensions: 0.090 inch (2.3 mm) thick each ½ inch (13 cm) wide, with 1/16 inch (1.5 mm) spacing between handles in the open or blade-deployed position, about 0.093 inch (2.3 mm) spacing between the arms of the "U"-section of each handle; the handle lock which is preferably of stainless steel, may have these dimensions: 0.090 inch (2.3 mm) thickness; ¾ inch (1.8 cm) length; 1½ inch (3.7 cm) width at forward end; 1¼ inch (2.9 cm) width at rearward end; ¼ inch (6 mm) slot width; ⅛ inch (3.2 mm) slot closed-end radius; 0.170 inch (4.3 mm) length along centerline of connection between legs; typical corner radii may be ⅛ inch (3.2 mm).

Stainless steel, as noted, that is tempered for hardness, is preferred but other suitable metals may be used for the member 20, which, in any event, is unitary.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of folding pocket tool of the type having blade with butt end and point end, paired handles with first and second ends and with "U"-sections forming in each handle a groove along one side open at the second ends and a spine along the other side, means pivoting first ends to the handles to the butt end of the blade for encasing an edge of the blade in the grooves for storage and for swinging around to a use-position with the blade exposed and the spines of the handles together for gripping and means for holding the spines together detachably, the means for holding comprising: a plate having first and second legs and a connection, therebetween forming a slot with an open end and a closed end, the plate proportioned for force-fit into the second ends of the handles with a portion of each said spine received in said slot, said proportion for force-fit including said legs bearing on the handles in said respective grooves and resiliently biasing the handles together, and means adapting the plate for use as a scraper blade, including the plate being of tempered steel of uniform thickness and proportioned for protruding as a scraper blade at the second ends of the handles.

2. In a system of folding pocket tool of the type having blade with butt end and point end, paired handles with first and second ends and with "U"-sections forming in each handle a groove along one side open at the second ends and a spine along the other side, means pivoting first ends to the handles to the butt end of the blade for encasing an edge of the blade in the grooves for storage and for swinging around to a use-position with the blade exposed and the spines of the handles together for gripping and means for holding the spines together detachably, the means for holding comprising: a plate having first and second legs and a connection, therebetween forming a slot with an open end and a closed end, the plate proportioned for force-fit into the second ends of the handles with a portion of each said spine received in said slot, said proportion for force-fit including said legs bearing on the handles in said respective grooves and resiliently biasing the handles together, means adapting the plate for offset screwdriver use with finger clearance and for easy tap-off removal and for providing nonslip hand grip of the handles, including: the plate being proportioned for protruding from the handles at the sides thereof, and said protruding being at an inclined angle broadening in a direction toward the first ends of the handles.

3. In a system as recited in claim 2, means adapting the plate for use as a scraper, including the plate being proportioned for protruding at the second ends of the handles.

4. In a system of folding pocket tool of the type having blade with butt end and point end, paired handles with first and second ends and with "U"-sections forming in each handle a groove along one side open at the second ends and a spine along the other side, means pivoting first ends to the handles to the butt end of the blade for encasing an edge of the blade in the grooves for storage and for swinging around to a use-position with the blade exposed and the spines of the handles together for gripping and means for holding the spines together detachably, the means for holding comprising: a plate having first and second legs and a connection, therebetween forming a slot with an open end and a closed end, the plate proportioned for force-fit into the second ends of the handles with a portion of each said spine received in said slot, said proportion for force-fit including said legs bearing on the handles in said respective grooves and resiliently biasing the handles together, and said proportion for force-fit including the slot closed end being rounded for urging the handles together.

5. In a system as recited in claim 4, said handles having recessed portions adjacent said slot rounded closed end.

* * * * *